United States Patent [19]

Grenon

[11] Patent Number: 4,508,030

[45] Date of Patent: Apr. 2, 1985

[54] METAL BINDING WIRE TWISTING DEVICE

[76] Inventor: René Grenon, Victor Hugo St., 21, 77181 Courtry, France

[21] Appl. No.: 441,534

[22] PCT Filed: Mar. 23, 1982

[86] PCT No.: PCT/FR82/00057

§ 371 Date: Nov. 3, 1982

§ 102(e) Date: Nov. 3, 1982

[87] PCT Pub. No.: WO82/03368

PCT Pub. Date: Oct. 14, 1982

[30] Foreign Application Priority Data

Mar. 26, 1981 [FR] France ..... 81 06106

[51] Int. Cl.[3] ..... B65B 13/28

[52] U.S. Cl. ..... 100/26; 100/31; 140/119

[58] Field of Search ..... 100/10, 25, 29, 31, 100/26; 140/93.6, 119, 49

[56] References Cited

U.S. PATENT DOCUMENTS 2,346,209 4/1944 De Wald ..... 140/119 X 3,470,813 10/1969 Nomm ..... 100/26 X 3,557,684 1/1971 Glasson ..... 100/26

3,929,063 12/1975 Stromberg et al. ..... 100/31 X 4,252,157 2/1981 Ohnishi ..... 140/119 X 4,301,720 11/1981 Elineau ..... 100/31 X

FOREIGN PATENT DOCUMENTS 470138 of 1929 Fed. Rep. of Germany ..... 100/26

*Primary Examiner*—Billy J. Wilhite

*Attorney, Agent, or Firm*—Murray, Whisenhunt and Ferguson

[57] ABSTRACT

Metal binding wire twisting device.

Two clamps (17, 18) are disposed to clamp and retain the wire in the groove in a wire guide (19) close to the rotating head (1) which is associated with an abutment member (12) which stops feeding of the wire and cutting means (13) and has a central recess (4) open in the direction towards the object (S) to be bound and into which open inclined radial passages (2, 3) for the wire, the ends of which are twisted by rotation of the head (1) to form a twist whose configuration is imposed by the internal configuration of the central recess (4).

12 Claims, 13 Drawing Figures

METAL BINDING WIRE TWISTING DEVICE

Figure 1:
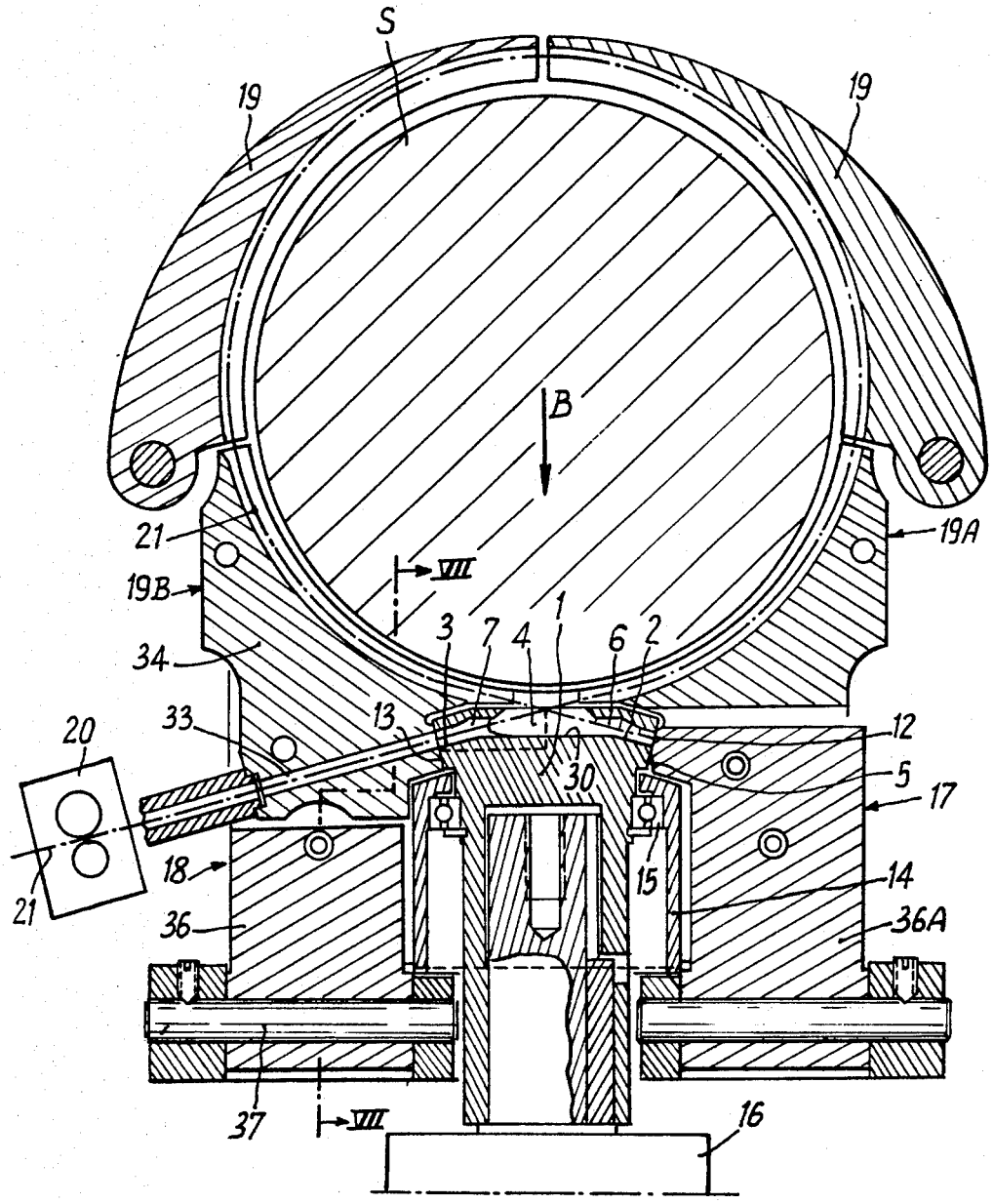

The invention concerns a device for twisting together the two ends of a metal binding wire.

Many devices for this purpose are already known. The state of the art in this area may be illustrated by the following patents: DE No. 1 511 828—U.S. Pat. No. 3,470,813—U.S. Pat. No. 4,252,157—FR No. 1 576 602.

With most of the known devices, the loads on the two ends of the binding wire during twisting are different, with the result that the twist is asymmetrical and the strength is reduced. Also, these devices comprise clamps for holding the ends of the binding wire disposed on the opposite side of the twist to the object which is bound, so that forming the twist often results in stretching of the wire, which may be excessive and result in constriction and further reduction in strength.

Also, as the wire ends are held in the clamps, it is necessary to bend them down against the object which has been bound after forming the twist.

Finally, the binding wire is necessarily longer than the length strictly required for forming the twist itself.

A principal objective of the invention is to provide a device for twisting together the two ends of a metal binding wire without further stretching same, using only the length of wire strictly required, and eliminating any necessity to bend down the ends of the twisted wire or the twist itself.

In a device for twisting together the two ends of a wire binding an object, comprising a grooved wire guide having a fixed part containing a rotatable twisting head having two oppositely-disposed inclined passages communicating with a lateral surface of the head and aligned with the groove when the head is in a stopped position, in accordance with the invention two oppositely-disposed clamps are adapted to immobilize respective wire ends in the wire guide close to the head and the head has a central recess open in the direction towards the inside of the wire guide and into which the oppositely-disposed passages open, the central recess having an internal configuration appropriate to the twist to be effected.

An abutment member is disposed opposite the external opening of one passage and cutting means are disposed symmetrically thereto in correspondence with the external opening of the opposite passage.

The lengths of said passages are preferably such that the wire is cut to the exact length required to form the twist.

In one embodiment of the invention, the cutting means comprise a fixed part of the wire guide in which is formed a wire guide channel in alignment with the corresponding passage, and each clamp is respectively constituted by the fixed part of the wire guide and a movable jaw adapted to immobilize the wire in the groove of the wire guide.

In a preferred embodiment of the invention, the central recess is generally cylindrical with a flat transverse base surface and has a diameter equal to that of the twist to be formed and a depth equal to the length of the twist to be formed; the inclined passages are widened in the direction towards the wire guide before reaching the central recess by virtue of internal recesses which permit the ends of the wire to lie in a transverse plane when they are urged against the flat transverse base surface; and the central recess is widened on the side corresponding to each passage and in the direction opposite to the direction of rotation of the head by a lateral recess having a base which is directed upwardly from the flat transverse base surface towards the wire guide so as to push back each end of the wire in such a way as to twist it in the opposite direction.

Figure 2:
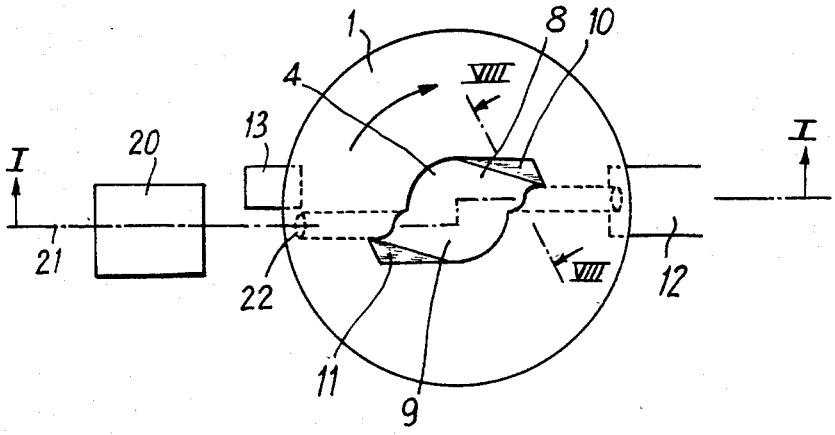
Figure 3A:
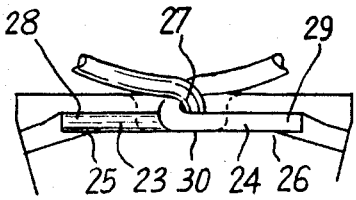
Figure 4A:
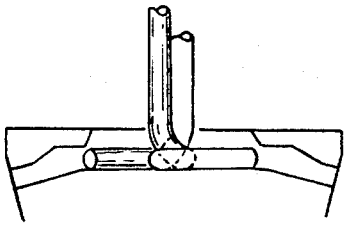
Figure 3B:
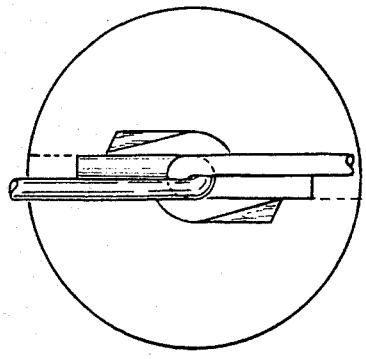
Figure 4B:
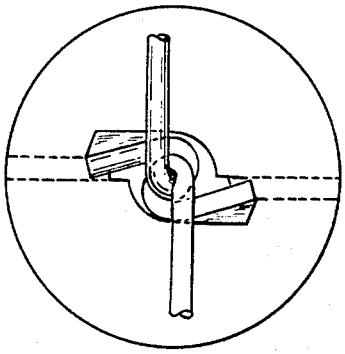
Figure 5A:
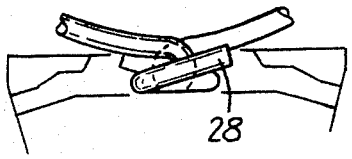
Figure 5B:
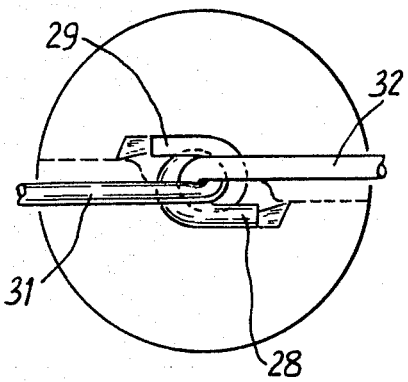
Figure 6B:
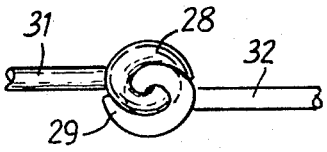
Figure 6A:
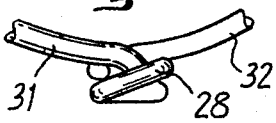
Figure 6C:
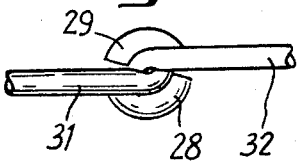
Figure 8:
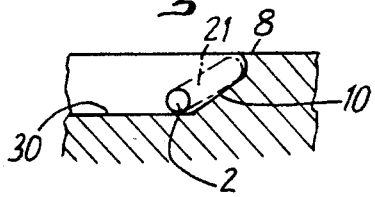
Figure 7:
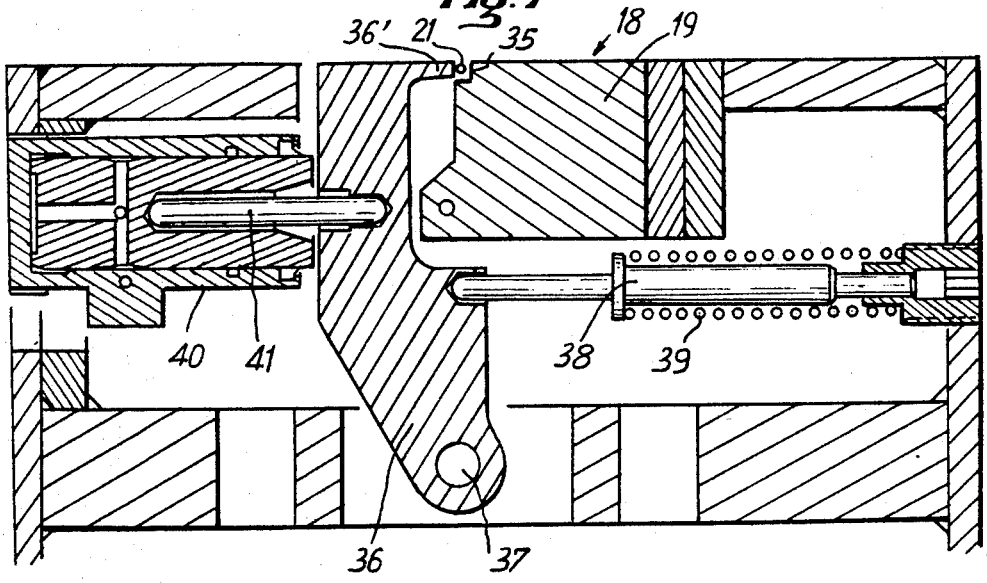

A preferred embodiment of the invention will now be described by way of non-limiting example and with reference to the accompanying drawings, in which:

FIG. 1 is a view of the twisting device in accordance with the invention, in cross-section on the line I—I in FIG. 2, FIG. 2 is a view along the axis of the twisting head, in the direction of arrow B in FIG. 1, the clamps not being shown, FIGS. 3*a* and 3*b* show the position of the wire after the twisting member has rotated through approximately half a turn, FIGS. 4*a* and 4*b* are similar views after rotation of approximately three-quarters of a turn, FIGS. 5*a* and 5*b* are similar views after rotation of approximately one turn, FIGS. 6*a* to 6*c* show the finished twist from the side, from below and from above, respectively, FIG. 7 is a view in cross-section on the line VII—VII in FIG. 1, showing one jaw of one wire retaining clamp, FIG. 8 is detail view in cross-section on the line VIII—VIII in FIG. 2, showing a raised surface.

For a better understanding of the construction of the device in accordance with the invention, it is preferable to begin with an outline description followed by an explanation of its operation. This will better disclose the purposes of certain constructional details which will be described in full later.

A device in accordance with the invention comprises a single body of revolution constituting a twisting head 1 of symmetrical construction, having two inclined cylindrical passages 2 and 3, a central recess 4, a conical external section 5, two recesses 6 and 7 inside passages 2 and 3, and two recesses 8 and 9 with raised base surfaces 10 and 11.

The twisting head is associated on one side with an external abutment member 12 disposed opposite cylindrical passage 2, and fixed cutting means 13 adapted to cooperate with the end of the other passage 3.

Part 1 is maintained in position in a supporting framework 14 by two bearings 15 and is driven in rotation by external means 16 which are known per se. Two independent and symmetrically disposed clamps 17 and 18 also constitute parts of the device and are each adapted to hold one end of the wire in position. They will be described in more detail later.

A wire guide 19 known per se defines a continuous guide circuit around the object S to be bound, an external driving device 20 known per se being used to push-feed the binding wire 21, which is shown as a chain-dotted line in order to simplify the drawing.

Initially, the forward end of the binding wire is at the cutter and the object S to be bound is inside wire guide 19. The twisting head 1 is stopped at a position in which the continuity of wire guidance is ensured by passage 3, wire guide 19 and passage 2.

Driving unit 20 pushes binding wire 21 into passage 3 and thence into clamp 17, into wire guide 19, into clamp 18 and into passage 2. The wire stops in contact with abutment member 12.

Clamp 18 closes and holds binding wire 21 while driving unit 20 reverses its rotation and tightly binds object S by pulling on binding wire 21.

At the end of this tightening clamp 17 closes and holds binding wire 21. Driving unit 20 stops and twisting head 1 begins to rotate. The binding wire is immediately cut between fixed blade 13 and the external edge 22 of passage 3. Rotation of head 1 continues and the two free ends 23 and 24 of the binding wire begin to wrap around one another, the necessary length being obtained by virtue of axial sliding of these end parts of wire 21 into passages 2 and 3.

After partial rotation, straight sections 23 and 24 pivot about corners 25 and 26 in passages 2 and 3, under the effect of the advance of the first part of the twist 27, the extreme end sections 28 and 29 of wire ends 23 and 24 entering internal recesses 6 and 7. At this moment the twist 27 comes into contact with the base surface 30 of central recess 4 and the twist being formed has the configuration shown in FIG. 3. Continued rotation of twisting head 1 obliges the wire to wrap spiral-fashion around the first part of the twist 27 and parallel to base 30 of recess 4, recesses 8 and 9 enabling the binding wire ends 23 and 24 to become oriented in the plane of the spiral part of the twist. The twist being formed then has the configuration shown in FIG. 4.

Further rotation of twisting head 1 results in the extreme end portions 28 and 29 of the binding wire reaching raised surfaces 10 and 11. They are then raised in the direction towards the beginning of twist 27. This results in a reversal of the direction of progression of the twist, so that a second layer covers the first turn. The twist being formed then has the configuration shown in FIG. 5. Further rotation of twisting head 1 results in complete wrapping on of extreme end parts 28 and 29, which finally arrive in contact with parts 31 and 32 of binding wire 21 surrounding object S.

The finished twist then has the configuration shown in FIGS. 6*a*, 6*b* and 6*c*. It projects only slightly relative to the object bound and has only rounded surfaces terminated by a flat end surface.

A twist formed in this way combines good appearance with strength by virtue of the two superposed turns.

The device for executing it has only three moving parts: twisting head 1 and clamps 17 and 18.

The reader will now be in a position to better understand the following detailed description of these three parts.

In head 1, passages 2 and 3 are symmetrically inclined and substantially aligned with wire guide 19. Each of passages 2 and 3 has an external opening on the lateral surface of head 1.

In the normal stopped position of head 1, the external opening of passage 2 opposite driving unit 20 is very close to fixed external abutment member 12, whereas the external opening of passage 3 on the side of driving unit 20 is aligned with a channel 33 bored in a fixed part 19B of wire guide 19 to constitute cutting means 13. Channel 33 also guides wires 21 from driving unit 20 which feeds wire 21. The latter is cut, as soon as head 1 begins to rotate, by virtue of the movement of passage 3 relative to channel 33. The lengths of passages 2 and 3 are such that the wire is cut exactly to the length required to form the twist as shown in FIG. 6*a*. Thus there is no excess length to be cut off afterwards and the finished twist does not need bending down.

Inside head 1, inclined passages 2 and 3 open into central recess 4 which has a base surface 30 which is flat, or in other words disposed in a plane perpendicular to the axis of rotation of head 1. Opposite its base surface 30, central recess 4 is open in the direction towards the inside of wire guide 19, in other words towards object S to be bound. Before reaching central recess 4, passages 2 and 3 are widened in the direction towards wire guide 19 and object S by internal recesses 6 and 7. These enable the wire to lie wholly in a transverse plane as soon as it moves out of the inclined sections used to begin the twist. This situation is shown in FIG. 3*a*. The transverse flat base surface 30 confers on the wire the flat terminal end face of the twist, as seen in FIG. 4*a*. It will therefore be clear that the depth of central recess 4 is equal to the length of the twist to be formed.

Central recess 4 is widened on the side corresponding to each of passages 2 and 3 and in a direction opposite to the direction of rotation of head 1 by lateral recesses 8 and 9. In the radial direction, these are at least as long as free ends 23 and 24 of wire 21 after they assume their flat transverse configuration, as previously explained and as seen in FIG. 4*b*.

As shown in FIG. 8, each lateral recess 8 and 9 has a base surface which is directed progressively upwardly from base surface 30 of central recess 4 towards wire guide 19 and object S. Each base surface 10 and 11 is raised in such a way as to push back the respective extreme end parts 28 and 29 of the wire in the direction opposite to the first turn. Thus each extreme end part 28 and 29 of the wire is pushed back as soon as wire 21 is completely withdrawn, by virtue of its being twisted, from internal recesses 6 and 7 in passages 2 and 3. FIG. 4*b* shows the wire at the moment when this upward movement is about to commence. Further rotation results in wrapping in the reverse direction (FIGS. 5*a* and 5*b*), as already explained, until the final configuration shown in FIGS. 6*a* to 6*c* is obtained.

Apart from lateral recesses 8 and 9, central recess 4 is cylindrical, having a diameter equal to that of the finished twist as measured across the second, reversed turn (FIG. 6*b* and 6*c*). Consequently, once the twist is completed, head 1 could continue to rotate indefinitely without risk of breaking or applying further tension to wire 21.

This result is achieved by virtue of the fact that head 1 twists only the free ends of the wire cut exactly to the required length, the tension clamping the wire around object S being maintained during this by clamps 17 and 18.

FIG. 7 shows that each of clamps 17 and 18 comprises a body 34 which constitutes a fixed part (19A or 19B) of wire guide 19 and in which is formed a wire guide groove 35. Close to head 1 and on either side thereof is a movable jaw 36 pivoting on a radial shaft 37. Each jaw is shaped so as to terminate in a tip section 36' constituting part of the wall of groove 35 open towards the object to be bound, in a manner known per se. Associated with jaw 36 are a plunger 38 loaded by a spring 39 acting in the direction to open it and an actuator 40 with push rod 41 acting in the direction to close it. Each jaw 36 is disposed on the direction opposite to the first turn. Thus each extreme end part 28 and 29 of the wire is pushed back as soon as wire 21 is completely withdrawn, by virtue of its being twisted, from internal recesses 6 and 7 in passages 2 and 3. FIG. 4*b* shows the wire at the moment when this upward movement is about to commence. Further rotation results in wrapping in the reverse direction (FIGS. 5*a* and 5*b*), as already explained, until the final configuration shown in FIGS. 6*a* to 6*c* is obtained.

Apart from lateral recesses 8 and 9, central recess 4 is cylindrical, having a diameter equal to that of the finished twist as measured across the second, reversed turn (FIG. 6*b* and 6*c*). Consequently, once the twist is completed, head 1 could continue to rotate indefinitely without risk of breaking or applying further tension to wire 21.

This result is achieved by virtue of the fact that head 1 twists only the free ends of the wire cut exactly to the required length, the tension clamping the wire around object S being maintained during this by clamps 17 and 18.

FIG. 1 shows that each of clamps 17 and 18 comprises a body 34 which constitutes a fixed part (19A or 19B) of wire guide 19 and in which is formed a wire guide groove 35 (FIG. 7). Close to head 1 and on either side thereof is a movable jaw 36 pivoting on a radial shaft 37. Each jaw is shaped so as to terminate in a tip section 36' constituting part of the wall of groove 35 open towards the object to be bound, in a manner known per se. Associated with jaw 36 are a plunger 38 loaded by a spring 39 acting in the direction to open it and an actuator 40 with push rod 41 acting in the direction to close it. Each jaw 36 is disposed on the fixed part of wire guide 19, as close as possible to rotating head 1. With jaws 36 in the closed position, wire 21 is tightly clamped in groove 35 and immobilized against any sliding motion, the fixed part of the wire guide serving as the second jaw of the clamp.

When the wire placed around object S to be bound is clamped in clamp 18, close to head 1, on the side of channel 33, the tension in wire 21 may be accurately adjusted by backward motion of driving unit 20. The closing of the second clamp 17 on the side of abutment member 12 at which wire 21 arrives maintains this tension. The tension is maintained while the twist is being formed, as only the free ends of the wire beyond clamps 17 and 18 are involved, the clamps gripping the wire between head 1 and object S.

Note that movable jaw 36A (FIG. 1) of clamp 17 has a lateral surface disposed very close to head 1 so as to serve as abutment member 12 which stops feeding of wire 21.

The inclusion and positioning of clamps 17 and 18 are an essential characteristic. By virtue of these clamps, the free ends of the wire are twisted without varying its tension. Twisting could be carried out in any manner required by means of an appropriate and corresponding configuration of central recess 4 into which passages 2 and 3 open. The configuration described hereinabove is preferred since it forms a twist with particular advantages. It will be clear that, on the basis of the invention as disclosed herein, the man skilled in the art could readily adopt any other configuration for the internal recess in the head, so as to obtain a different type of twist, without departing from the scope of the invention.

What is claimed is:

1. A device for twisting together the two ends (23,24) of a wire (21) binding an object (S) comprising a wire guide (19) with a groove (35) and a fixed part (19A,19B) containing a rotatable twisting head (1) having a central recess (4) with two oppositely-disposed inclined passages (2,3) and aligned with the groove (35) when the head (1) is in a stopped position, wherein two oppositely disposed clamps (17,18) are adapted to immobilize respective ends of the wire (21) in the wire guide (19) close to the head (1), said clamps (17,18) each gripping said wire (21) between the head (1) and the object (S), and the oppositely-disposed inclined passages (2,3) are cylindrical passages opening in a lateral surface of the head, an abutment member (12) is disposed opposite the external opening of one passage (2) and cutting means (13) are disposed in correspondence with an external opening of the opposite passage (3) to cooperate with said external opening for cutting the wire.

2. A device according to claim 1, wherein the lengths of the passages (2,3) determine the exact length required to form the twist.

3. A device according to claim 1, wherein the cutting means (13) comprise a fixed part (19A) of the wire guide (19) in which is formed a guide channel (33) for the wire (21) in alignment with the corresponding passage (3).

4. A device according to claim 1, wherein each clamp (17,18) is constituted by the fixed part (19A,19B) of the wire guide (19) and a movable jaw (36,36A) adapted to immobilize the wire (21) in the groove (35) of the wire guide (19).

5. A device according to claim 4, wherein one movable jaw (36A) has a lateral surface close to the head (1) which constitutes the abutment member (12) for the wire (21).

6. A device according to claim 1, wherein the central recess (4) is cylindrical with a flat transverse base surface (30) and has a diameter equal to that of the twist to be formed and a depth equal to the length of the twist to be formed, the inclined passages (2,3) are widened in the direction towards the wire guide (19) before reaching the central recess (4) by virtue of internal recesses and the central recess (4) is widened on the side corresponding to each passage (2,3) and in the direction opposite to the direction of rotation of the head (1) by a lateral recess (8,9) having a base which is directed upwardly from the flat transverse base surface (30) towards the wire guide (19) so as to push back each end (23,24) of the wire (21) in such a way as to twist it in the opposite direction.

7. A device for twisting together the two ends of a wire, binding an object or objects, comprising: a wire guide for guiding a wire about an object or objects to be bound, said wire guide having a groove receivable of said wire and a fixed part containing a rotatable twisting head; said rotatable twisting head having a central recess with two oppositely-disposed inclined cylindrical bores, receivable of said wire, passing outwardly from said central recess through said head, said bores aligned with said groove when said head is in a stopped position; two oppositely disposed clamps are adapted to immobilize respective ends of the wire in said wire guide, said clamps being located between said head and said object or objects to be bound; an abutment member is disposed opposite the outer opening of one of said bores, when said head is in said stopped position, said abutment member preventing wire from passing through said outer opening; and cutting means for cutting said wire upon rotation of said head are disposed in correspondence with the outer opening of the opposite bore, said cutting means cooperating with said outer opening to cut said wire.

8. The device as claimed in claim 7, wherein the lengths of said oppositely disposed bores through said head determine the exact length of wire to form the twist.

9. The device as claimed in claim 7, wherein said cutting means comprises a guide channel, formed in said fixed part of the wire guide, which is in alignment with one of said bores when said head is in said stopped position, whereby upon rotation of said head said wire is sheared between said guide channel and said bore.

10. The device as claimed in claim 7, wherein each clamp comprises the fixed part of said wire guide and a respective movable jaw adapted to immobilize the wire in said groove of said wire guide.

11. The device as claimed in claim 10, wherein a lateral surface of one of said movable jaws constitutes said abutment member.

12. The device as claimed in claim 7, wherein said central recess is cylindrical with a flat transverse base surface and has a diameter equal to that of the twist to be formed and a depth equal to the length of the twist to be formed; said inclined bores are widened by respective internal recesses in the direction towards said wire guide before reaching said central recess, thereby causing the respective ends of the wire to lie in the transverse plane upon partial rotation of said head; said central recess is widened by respective lateral recesses, adjacent said inclined bores, opening in the direction opposite to the direction of rotation of said head and having a base which is directed upwardly from said flat transverse base surface towards said wire guide thereby causing the respective ends of the wire to twist in the opposite direction upon complete rotation of said head.

* * * * *